US006794592B1

(12) United States Patent
Liu et al.

(10) Patent No.: US 6,794,592 B1
(45) Date of Patent: Sep. 21, 2004

(54) DUSTPROOF AND WATERPROOF SWITCH

(75) Inventors: Chih-Song Liu, Taoyuan (TW); Jui-Jung Chiu, Taoyuan (TW)

(73) Assignee: Solteam Electronics Co., Ltd., Taoyuan Hsien (TW)

( * ) Notice: Subject to any disclaimer, the term of this patent is extended or adjusted under 35 U.S.C. 154(b) by 0 days.

(21) Appl. No.: 10/682,118

(22) Filed: Oct. 10, 2003

(30) Foreign Application Priority Data

Sep. 16, 2003 (TW) ..... 92216607 U

(51) Int. Cl.[7] ..... H01H 19/06
(52) U.S. Cl. ..... 200/302.3; 200/339
(58) Field of Search ..... 200/302.1–302.3, 200/315, 316, 339

(56) References Cited

U.S. PATENT DOCUMENTS 3,320,389 A * 5/1967 Arlauskas ..... 200/302.3
4,218,602 A * 8/1980 Creech ..... 200/302.3
4,667,073 A * 5/1987 Osika ..... 200/315
4,937,407 A * 6/1990 Osika ..... 200/302.3
5,053,591 A * 10/1991 Theurer ..... 200/315
5,660,270 A * 8/1997 Martin et al. ..... 200/302.3
5,712,450 A * 1/1998 Chan et al. ..... 200/302.3
5,752,595 A * 5/1998 Fein et al. ..... 200/315
6,380,500 B1 * 4/2002 Lin ..... 200/302.3
6,559,398 B2 * 5/2003 Takeda et al. ..... 200/339

* cited by examiner

*Primary Examiner*—James R. Scott
(74) *Attorney, Agent, or Firm*—Troxell Law Office PLLC

(57) ABSTRACT

A dustproof and waterproof switch includes a casing, a contact pole device, an axial joint member, a catch member and a covering member. The characteristic is in that the axial joint member is placed in the casing and lap joined to support members the axial joint member having a fitting hole at the center thereof and having an axial plate at the front and the rear sides thereof respectively; the catch member is formed a frame and placed in a mold to allow the concave downward plane at the top thereof joined to the upper arc recess of the covering member, which is made by way of injection molding, and the catch member is attached between the two axial plates with the bottom thereof having a central hollow post fitting with an extendable stir rod and the stir rod piercing the rod plate and the lower end of the stir rod contacting with the arc contact pole; and the covering member at the bottom edge thereof extends an inner connecting rim for fitting with the casing and covering the upper part of the casing.

10 Claims, 2 Drawing Sheets

DUSTPROOF AND WATERPROOF SWITCH

BACKGROUND OF THE INVENTION

1. Field of the Invention

The present invention relates to a switch and particularly to a dustproof and waterproof switch.

2. Description of Related Art

It is known that the switch has been used for years in the field of power supply as a required device for controlling the power on or off and avoiding accidents caused by continuing supplying the power. The switch usually can be classified into a constant on switch, which is off at the time of the current being not taken, and a constant off switch, which is on at the time of the current being taken. Thus, products powered by the electricity have provided with a switch and the basic principle for operating a switch is in that two electric poles are utilized to connect with each other as a close circuit for constituting a state of current taking and the two electric poles disconnect from each other as an open circuit to form a state of current not taking.

Generally, safety is also an important factor has to be considered in addition to an accurate operation of power on or power off. For instance, the switch has to be free from leakage of electricity and incorrect connection. Besides, the switch has to be dustproof and waterproof in special locations such as a working environment with floating power dust or heavy moisture such that it can prevent the contact pole device in the switch from short circuit or corrosion and prolong the life span of the switch. A Taiwanese utility model No. 202467 (corresponding U.S. Pat. No. 6,713,697) discloses a dust and moisture switch, which includes a casing with the bottom thereof being inserted with a stationary pole plate and a support pole plate, an arc contact pole being lap joined to the support pole and being possible to swing leftward and rightward, a catch plate at the bottom thereof having a central hollow rod fitting with an extendable stir lever with the stir lever at the lower end thereof contacting with the arc contact pole, and an isolation part made of soft high molecular plastics for being passed through by and fitting with the stir lever so as to be located at and tightly joined to the inner walls of the casing. Thus, an effect of preventing the power dust and moisture from entering the bottom of the casing can be performed. However, the prior art is belonged to inner covering type isolation and the isolation part is made of high molecular plastics and is disposed between the catch plate and the casing so as to block the power dust and the moisture entering the bottom of casing so that the contact pole device can be free from foreign influence.

SUMMARY OF THE INVENTION

The crux of the present invention is to provide a dustproof and waterproof switch, which includes a hollow casing, having a bottom with two pole holes, extending outward a case frame from a top thereof and providing a support member at an inner wall thereof; a contact pole device, having a stationary pole and a support pole being inserted into and locating at one of the pole holes and having an arc pole attached to a top of the support pole such that the arc pole can swing leftward and rightward; an axial joint member, being disposed in the casing and lap joining with the support pole, providing a central fitting hole with a front side and a rear side of which extending a joining plate; a catch member, being provided with a shape of frame with a concave downward upper plane at the central top thereof, having a front and a rear walls with an axial hole respectively to correspond to the two axial projections, at a bottom thereof extending downward a hollow post for receiving and locating an extendable stir rod, an elastic piece being placed between the hollow post and the stir rod to allow the stir rod contacting with the arc contact pole constantly; and a covering member, being made of high molecular plastic material, having inner walls of an arc recess part at a top thereof joining with the concave downward upper plane of the catch member by way of injection molding and having a joining rim at a bottom edge thereof for fitting with the casing frame and closing an upper part of the casing completely. An end of the covering member is pressed down, the stir rod can slide on the arc contact pole to selectively contacts with or detaches from a stationary contact pole in the switch for performing power on or off.

BRIEF DESCRIPTION OF THE DRAWINGS

The present invention can be more fully understood by reference to the following description and accompanying drawings, in which.

DETAILED DESCRIPTION OF THE PREFERRED EMBODIMENT

Figure 1:
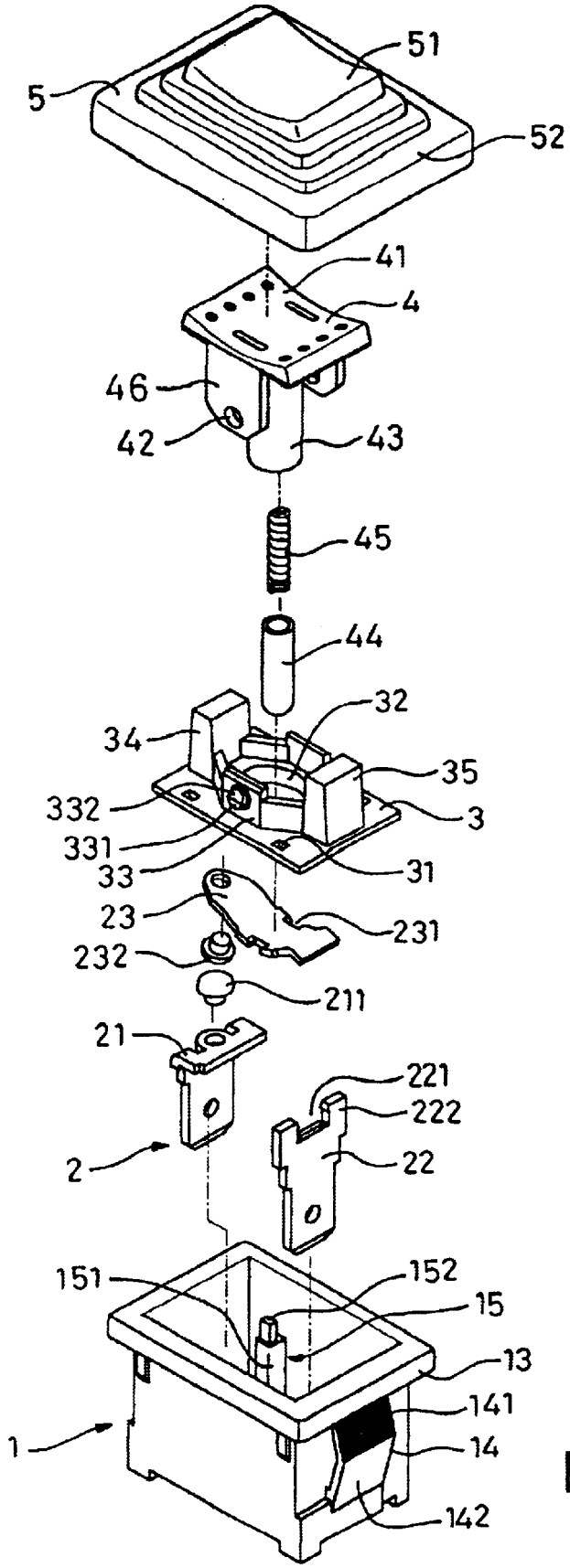
FIG. 1 is an exploded perspective view of a dustproof and waterproof switch according to the present invention.

Referring to FIG. 1, basically, a dustproof and waterproof switch according to the present invention includes a casing 1, a contact pole device 2, an axial joint member 3, a catch member 4 and a covering member 5.

Wherein, the casing 1 is a hollow base with two pole holes 11, 12 at the bottom thereof for being inserted with and positioning the contact pole device 2. The casing 1 at the top thereof extends outward a casing frame 13 to act as a stopper for the contact pole device 2 while the contact pole device 2 is inserted into preset holes of an electric appliance and being covered by the covering member 5. Besides, the casing 1 at the left and the right walls thereof is provided with a bow-shaped elastic buckle 14 respectively and the central bent part of the casing 1 provides a buckle line section 141 and a flat section 142 at the upper and lower sides thereof. The flat section 142 performs as guidance while the contact pole device 2 is inserted into the preset holes of the electric appliance and the buckle line section 141 provides a positioning effect at rims of the preset holes. The characteristic of the present invention is In that a support member 151 is arranged at the inner wall surface of the casing 1 for being surrounded by the axial joint member 3 while the axial joint member 3 is mounted to the casing 1. It can be seen in FIG. 1 that the support member 15 extends longitudinally a support post section 151 at two opposite lateral inner walls respectively with an upward extending inserting projection 152.

The contact pole device 2 is prior art and has a stationary pole 21 inserted in a pole hole 11 and a support pole 22 inserted in another pole hole 12. Further, an arc pole plate 23 is crossly inserted in the recess opening 221 of the support pole 22 such that two opposite engaging recesses 231 at the middle of the arc pole 23 engage with the recess opening 221 of the support pole 22.,Hence, the arc pole 23 can perform a leverage movement on the support pole 22 so that a movable joint 232 of the arc pole 23 can selectively touch or detach from a fixed joint 211 at the top of the stationary pole 21 to perform power on or off.

The axial joint member 3 is mounted on the support member 15 with, for example, being provided with fitting holes 31 corresponding to the inserting projections 152 for being pierced by the inserting projections 152. In this way, the axial joint member 3 can be attached to the support post sections 151. The axial joint member 3 at the center thereof has a fitting hole 32 for being passed through by a stir rod 44 and at two lateral sides thereof is provided with an a connecting plate 33 respectively with an axial projection 331 jutting out laterally at each connecting plate 33 for joining with the catch member 4 such that the catch member 4 can swing to the left and to the right on top of axial joint member 3. Each of the axial projections 331 at the top thereof has an inclining edge 332 to facilitate the axial joint member 3 connecting with the catch member 4. In addition, the axial joint member at the left and right sides thereof extends a left stopper 34 and a right stopper 35 respectively as limits to prevent the catch member 4 from excessive downward movement during being pressed down.

The catch member 4 is provided with a shape of frame with a concave downward upper plane 41 at the central top thereof so as to be capable of being operated with fingers. The front and rear walls 4–6 of the catch member 4 are provided with an axial hole 42 respectively to correspond to the two axial projections 331 such that the catch member 4 can be attached to the axial joint member 3 to facilitate operation of pressing. The catch member 4 at the bottom thereof extends downward a hollow post 43 for receiving and locating an extendable stir rod 44. For instance, an elastic piece 45, such as a spring, is placed between the hollow post 43 and the stir rod 44 to allow the stir rod 44 contacting with the arc contact pole 23 constantly for power ON/OFF being controlled.

The covering member 5 is made of high molecular plastic material such as PVC to form a shape of cap with upward reduced steps. The characteristic of the present invention is in that after the catch member 4 being formed by way of injection molding, the concave downward upper plane 41 is inserted into a mold before the covering member 5 being injected so that the concave downward upper plane 41 is joined to the covering member 5 between the inner walls of an arc recess part 51 at the top thereof. Hence, the covering member 5 can be associated with the catch member integrally. Besides, the covering member 5 at the bottom edge of the base step 52 thereof extends inward a joining rim 521 for fitting with the casing frame 13 such that the covering member 5 can close the top of the casing 1 completely and performance of being free from both the dust and the water cab be effective. Further, the covering member 5 with a shape of stepped cap provides an advantage of offering better flexibility of extension to avoid possible breakage during repeated operations.

Figure 2:
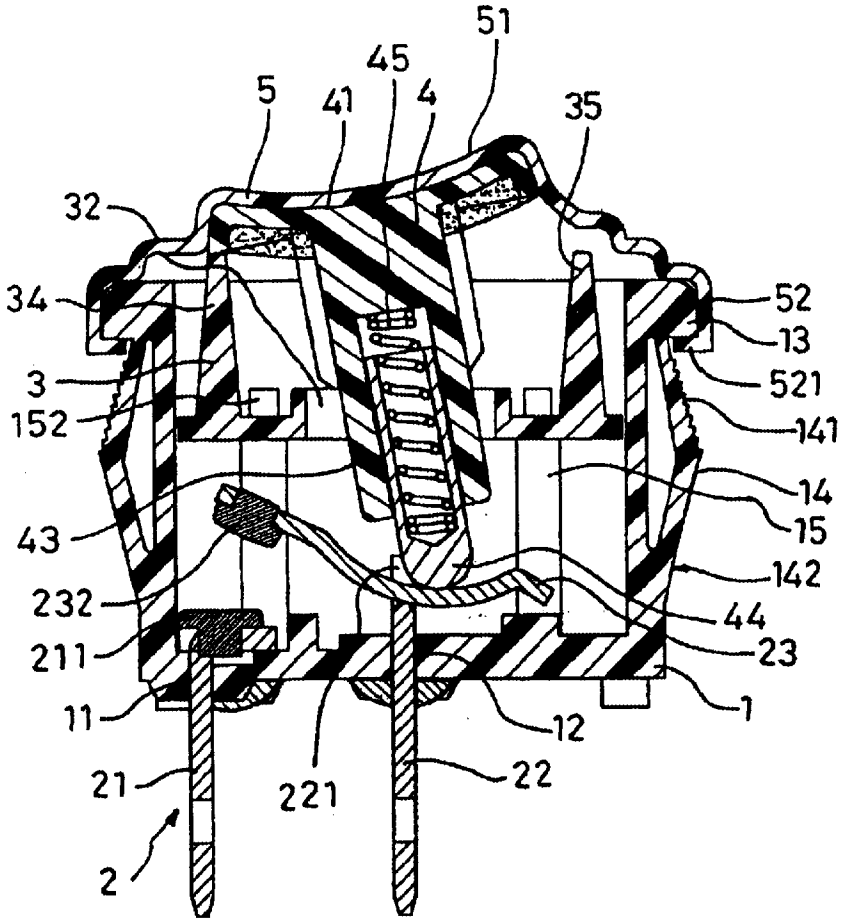
FIG. 2 is a sectional view of the switch according to the present invention illustrating the switch being in a state of off.
Figure 3:
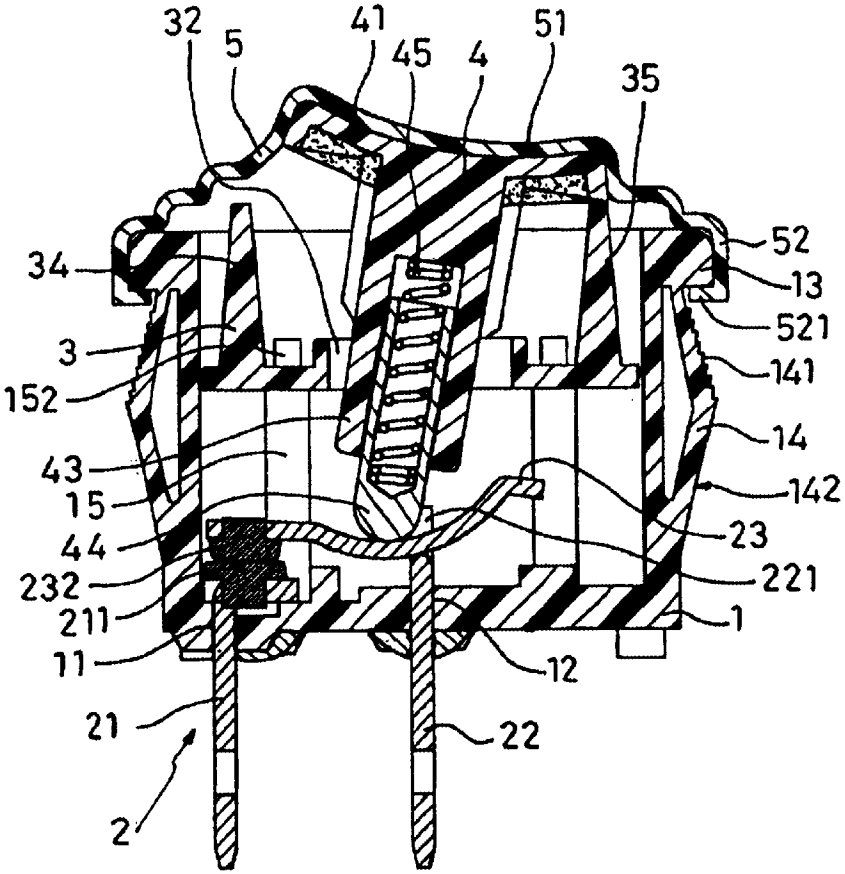
FIG. 3 is a sectional view of the switch shown in FIG. 1 having been assembled.

Referring to FIGS. 2 and 3, in practice, it is only necessary to press down the covering member 5 and the catch member 4, which is associated with the covering member 5, can move with the axial member 3 as a fulcrum to actuate the stir rod 44 underneath moving along the surface of the arc contact pole 23 such that the movable joint 232 can touch or skip away from stationary nodal point of the stationary contact pole 21 selectively to constitute power on or off. The covering member 5 closes the opening at the top of casing completely to prevent the dust and the water from entering the bottom of the casing 1 and to keep normal operation of the contact pole device 2. Moreover, the covering member 5 has excellent elasticity and the catch member 4 at both end edges thereof can be biased against the left stopper 34 and the right stopper 35 to limit the catch member 4 being pressed downward excessively and result in breakage of the covering member 5. Furthermore, it is not necessary to provide opposite fitting holes at the upper edge of the casing as it is done in the prior art so that there is no way for dust powder or liquid to pass through the casing and the life span of the switch can be extended effectively.

While the invention has been described with reference to the a preferred embodiment thereof, it is to be understood that modifications or variations may be easily made without departing from the spirit of this invention, which Is defined by the appended claims.

What is claimed is:

1. A dustproof and waterproof switch, comprising:

a hollow casing, having a bottom with two pole holes, extending outward a case frame from a top thereof and providing a support member at an inner wall thereof;

a contact pole device, having a stationary pole and a support pole being inserted into and located at one end of the pole holes and having an arc pole attached to a top of the support pole such that the arc pole can swing leftward and rightward;

an axial joint member, being disposed in the casing and connected with the support pole, providing a central fitting hole with a front side and a rear side located adjacent to a connecting plate;

a catch member, being provided with a shape of frame with a concave downward upper plane at the central top thereof, having a front and a rear walls with an axial hole respectively to correspond to the two axial projections, at a bottom thereof extending downward a hollow post for receiving and locating an extendable stir rod, an elastic piece being placed between the hollow post and the stir rod to allow the stir rod engaging with the arc contact pole constantly; and a covering member, being made of high molecular plastic material, having inner walls of an arc recess part at a top thereof joining with the concave downward upper plane of the catch member by way of injection molding and having a joining rim at a bottom edge thereof for fitting with the casing frame and closing an upper part of the casing completely;

whereby, when an end of the covering member is pressed down, the stir rod can slide on the arc contact pole to selectively engage with or detach from a stationary contact pole in the switch for turning power on or off.

2. The dustproof and waterproof switch as defined in claim 1, wherein the casing at right and left sides thereof includes an outwardly extending bow-shaped buckle respectively.

3. The dustproof and waterproof switch as defined in claim 2, wherein the casing includes at an upper portion thereof a buckle line section and at a lower portion thereof is a flat section.

4. The dustproof and waterproof switch as defined in claim 1, wherein the support member at two inner walls thereof extends longitudinally a section of support post with an insert projection extending from a top thereof.

5. The dustproof and waterproof switch as defined in claim 1, wherein the arc contact pole and the stationary contact pole have an end respectively opposite to each other with a movable nodal point attached to the end of the arc contact pole selectively engaging a stationary nodal point attached to the end of the stationary contact pole.

6. The dustproof and waterproof switch as defined in claim 1, wherein a spring is disposed between the hollow post and the stir rod.

7. The dustproof and waterproof switch as defined in claim 1, wherein the axial joint member extends outwardly an axial projection respectively to fit with a fitting hole provided at the front and the rear walls of the catch member respectively.

8. The dustproof and waterproof switch as defined in claim 1, wherein the axial projection at a top thereof has an inclining line.

9. The dustproof and waterproof switch as defined in claim 1, wherein the axial joint member at a left and a right sides thereof includes a left stopper and a right stopper as limits for the catch member at a left end edge and a right edge thereof when pressed leftward and rightward.

10. The dustproof and waterproof switch as defined in claim 1, wherein the covering member has a shape of steps and is made of PVC.

* * * * *